US005813066A

United States Patent [19]

Gebhard et al.

[11] Patent Number: 5,813,066

[45] Date of Patent: Sep. 29, 1998

[54] BABY REST

[76] Inventors: Albert W. Gebhard, 2101 East Alameda, Denver, Colo. 80209; Michelle D. Watson; Janine Meachen, both of 11 Eastgate St., Oakleigh, 316 VIC, Australia

[21] Appl. No.: 680,381

[22] Filed: Jul. 15, 1996

[51] Int. Cl.[6] ..... A47C 20/02

[52] U.S. Cl. ..... 5/655; 5/424

[58] Field of Search ..... 5/655, 655.3, 603, 5/622, 636

[56] References Cited

U.S. PATENT DOCUMENTS

| | | | |
|---|---|---|---|
| D. 255,966 | 7/1980 | Stadel | D6/604 |
| 1,738,411 | 12/1929 | Welch . | |
| 2,085,296 | 6/1937 | Carey | 5/630 |
| 2,234,506 | 3/1941 | Sistig | 5/630 |
| 2,521,530 | 9/1950 | McGuffage | 5/630 |
| 2,626,407 | 1/1953 | Kurry | 5/655 |
| 2,644,173 | 7/1953 | James | 5/331 |
| 3,089,153 | 5/1963 | Boso | 5/348 |
| 3,118,152 | 1/1964 | Talley, Jr. | 5/631 |
| 3,312,987 | 4/1967 | Emery | 5/655.3 |
| 3,419,923 | 1/1969 | Cowan | 5/655 |
| 3,761,975 | 10/1973 | Personett | 5/348 |
| 4,186,457 | 2/1980 | Amelung | 5/655 |
| 4,788,726 | 12/1988 | Rafalko | 5/431 |
| 5,092,005 | 3/1992 | Byrn | 5/636 |
| 5,103,514 | 4/1992 | Leach | 5/417 |
| 5,279,237 | 1/1994 | Alivizatos . | |
| 5,455,973 | 10/1995 | Brumfield et al. | 5/424 |

*Primary Examiner*—Steven N. Meyers
*Assistant Examiner*—Tuyet-Phuong Pham
*Attorney, Agent, or Firm*—John E. Reilly

[57] ABSTRACT

A baby rest for placement upon a support surface employs a generally C-shaped inflatable tube member surrounded by padding, the combination of the tube member and padding encased in a generally circular outer fabric cover. The outer cover substantially traverses the center area of the C-shaped tube, thereby creating a thinly padded, central rest area on which an infant may lie. The tube member can be inflated to varying degrees, such that the tube member and the surrounding padding create a peripheral guard around the center rest area of sufficient height to prevent an infant from rolling out of the proportionally smaller rest area.

4 Claims, 1 Drawing Sheet

BABY REST

BACKGROUND AND FIELD OF INVENTION

This invention relates generally to beds or cushions for infants or small children, and more particularly to a novel and improved baby recliner or rest which can be placed on a floor or other surface to comfortably support an infant.

A variety of mattresses, cushions and pads have been devised for use by both infants and adults which can be conveniently transported and placed on the ground or on a bed, for instance, to provide a comfortable resting place for a quick, convenient nap. Because small infants and even toddlers tend to roll off the edge of a bed or other surface without some kind of guard around the periphery, cushions and mats designed especially for use by infants preferably include a raised edge which will block the baby from rolling out of the inner portion of the pad and onto the floor. Parents often place rolled up blankets, towels, or pillows around a small child to keep him from falling off a bed unequipped with rails when a crib or child's bed is not available.

For instance, Bosc, U.S. Pat. No. 3,089,153, Welch, U.S. Pat. No. 1,738,411, and Brumfield, U.S. Pat. No. 5,455,973, each disclose mattresses or pads having a central rest area surrounded by a raised periphery. The patents to James, U.S. Pat. No. 2,644,173, and Personett U.S. Pat. No. 3,761,975 provide infant rest pads where the periphery is comprised of inflatable chambers extending around the rest area. James' invention is comprised of an impervious, waterproof sheet with the inflatable sides of unitary construction with the central rest area, while Personett's rest pad provides a plurality of lobes and interposed pockets in the inflatable chamber wall, the chamber walls again of unitary construction with the central rest area.

The above devices generally disclose mattresses and pads wherein a greater proportion of the pad serves as the rest area, with the peripheral guard comprising only a narrow edging around it. None of the above art shows a peripheral guard, whether comprised of an inflatable member or a resilient padding type of material, that appears to be of sufficient height and volume to actually prevent the infant from rolling off the central rest portion.

Thus, a need exists for a baby rest with a relatively small central portion that is surrounded by a proportionally much larger peripheral guard that can be conveniently inflated and deflated to aid in transport and storage. Unlike the above-described devices, the present invention combines an inflatable tube member with resilient padding material, both of which are encased in a removable and washable fabric cover, which, when stretched across the center of the tube, creates a central rest area, or platform, on which the infant can safely rest with minimal danger of rolling over the inflated periphery.

SUMMARY OF THE INVENTION

It is therefore an object of the present invention to provide a baby rest having a small central rest area relative to a larger, raised peripheral guard.

It is a further object of the present invention to provide a baby rest in which the peripheral guard is made up of an inflatable tube member surrounded by foam and an outer fabric cover.

It is yet another object of the present invention to provide a baby rest wherein the peripheral tube member is generally C-shaped and which substantially encircles the outer cover thereby eliminating any potentially dangerous crevices or openings.

Another object of the present invention is to provide a baby rest which can be inflated or deflated to selected degrees.

In accordance with the present invention, a baby rest employs a generally C-shaped inflatable tube member substantially surrounded by foam or padding. The tube and padding are snugly encased by an outer fabric cover, substantially circular in shape, and having a relatively short zippered opening around its outer circumference through which the tube may be inserted or removed when in a deflated state, thereby aiding in convenient transport and storage of the baby rest as well as washing of the soiled outer cover. When the tube member is inserted into the fabric cover and inflated, an inner platform or rest area defined by the tube member. When the baby rest is placed on the floor or other surface with the tube member inflated, the bottom surface of the rest will contact the support surface, but the inner platform created in the center of the rest will be slightly elevated from the support surface. The rest area may include a thin layer of padding for a more comfortable surface. While the preferred form of this invention contemplates a generally C-shaped tube defining the inner platform or rest area, a fully circular tube or foam padded cushion may also be employed if the zippered opening in the outer cover were extended further around the circumference of the cover to aid in removal of the tube or cushion.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
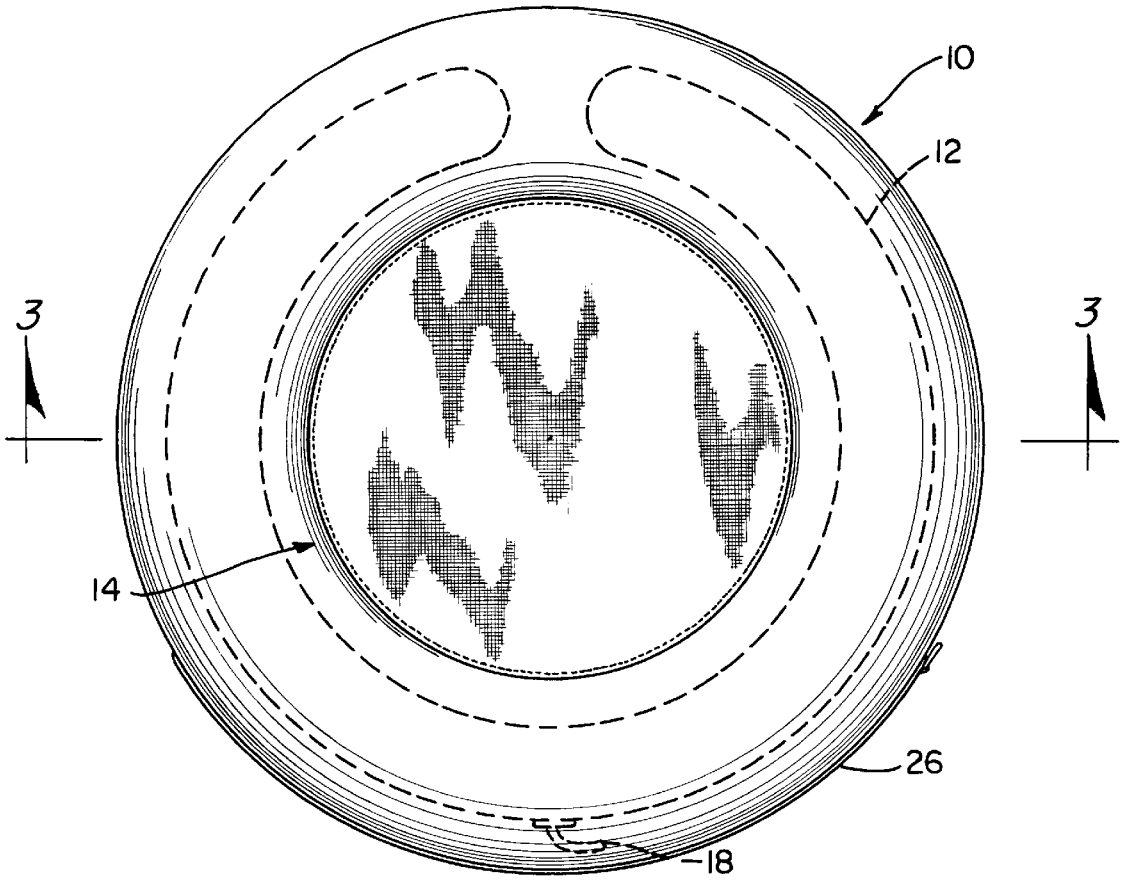
FIG. 1 is a top view of the baby rest of the present invention illustrating the generally C-shaped tube member.
Figure 3:
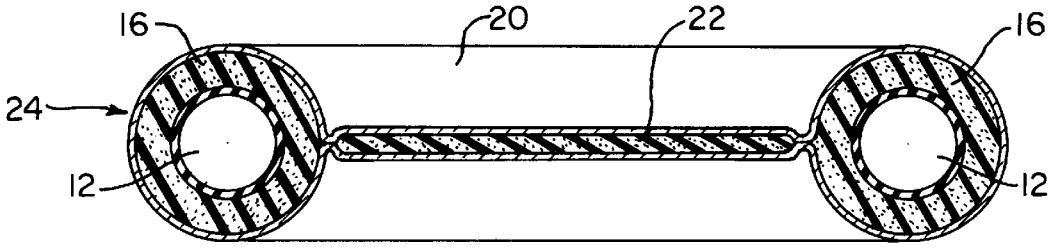
FIG. 3 is a cross-sectional view of the present invention taken along lines 3—3 of FIG. 1, illustrating the tube member surrounded by the padded material and the central rest area.

Referring now in detail to the accompanying figures, in particular to FIGS. 1 and 3, the baby rest 10 broadly comprises a generally C-shaped tube member 12 which defines a center region 14. The tube member 12 is surrounded by a padding material 16, preferably a dense foam or other resilient and flexible substance, the combination of the tube 12 and padding 16 forming the outer ring 24. As best shown in FIG. 1, as the tube member 12 is contemplated as being an inflatable device, the tube member 12 must therefore include a means for filling the tube with air, such as valve or nozzle 18.

Snugly encasing both the tube member 12 and the padding 16 is an outer fabric cover 20, preferably circular in configuration. As FIG. 3 illustrates, when the cover 20 is fitted about the tube member 12 and padding 16, a center rest area 22 is formed within the center region 14. The rest area 22 is made up of the outer fabric cover 20 that is filled with a thin layer of the padding material 16, thereby creating a comfortable resting surface for the baby. When the tube member 12 is inflated and the baby rest 10 is placed upon the floor or other support surface, shown in FIG. 3, the rest area 22 is elevated above the support surface, with approximately one-half of the outer ring 24 extending above the rest area 22 and approximately one-half of the outer ring 24 extending below the rest area 22. In this regard, the outer ring 24, comprised of the inflated tube member 12 and the surrounding padding 16, serves as a peripheral guard around the rest area 22, thereby preventing the baby from rolling off the baby rest 10.

Figure 2:
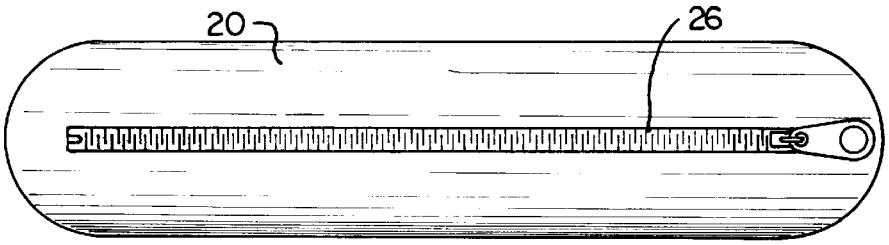
FIG. 2 is a side view of the present invention illustrating the zippered opening of the outer cover.

The outer cover 20 includes a zippered opening 26, shown in FIG. 2, extending partially about the circumference of the outer cover 20 to a length that will allow the deflated tube member 12 to be easily inserted into the cover and removed therefrom. While the preferred form of the present invention contemplates that the tube member 12 is generally C-shaped, the tube member 12 could also have the configuration of a full ring or doughnut.

The baby rest 10 is intended to provide a convenient napping mat which can be easily transported and stored. Thus, as noted above, it is preferable that tube member 12 be capable of inflation and deflation, not only to facilitate transport and storage, but also to allow the size of the outer ring 24 to be varied according to the intended use of the baby rest 10. For example, depending on where the baby rest 10 is to be placed, a higher periphery 24 may be desired to better prevent the infant from rolling off an elevated surface and injuring itself. In this regard, the C-shaped configuration of the tube member 12 is intended to substantially encircle the circular outer cover 20 to eliminate any potentially dangerous crevices or openings in the outer ring 24. Again, while the tube member 12 is preferably inflatable, it is also contemplated that tube member 12 can be made up of cushion-like material, whether the tube member 12 is in a ring shape or the illustrated C-shape.

It will be evident that the baby rest 10 possesses sufficient flexibility that it can be placed on various surfaces to comfortably support a baby, such as, for example, a floor, a bed, chair or sofa. The degree of flexibility as well as the spacing of the central rest area may be varied by varying the degree of inflation of the tube member. Moreover, the tube member 12 itself may serve as a head rest or a separate cushion or pad used in combination with the tube member 12 to provide a suitable headrest for the baby.

It is therefore to be understood that while the preferred form of the invention is herein set forth and disclosed, various modifications and changes may be made therein without departing from the spirit and scope of the present invention as defined by the appended claims.

We claim:

1. A baby rest for placement on a support surface, comprising:

an outer support member including a generally C-shaped tubular member terminating short of a full circle and resilient padding encasing said tubular member and extending throughout a full circle;

a central rest layer surrounded by said support member for elevation above said support surface and said support member extending above and below said layer thereby preventing an infant on said layer from rolling off said layer; and an outer cover snugly encasing said support member and said layer.

2. A baby rest according to claim 1 wherein said tubular member is an inflatable inner tube.

3. A baby seat according to claim 1 wherein said cover substantially traverses said center rest surface.

4. A baby rest according to claim 1 wherein said cover is substantially circular in configuration and includes a closable opening extending about its circumference.

* * * * *